US009238784B2

(12) United States Patent
Sato et al.

(10) Patent No.: US 9,238,784 B2
(45) Date of Patent: Jan. 19, 2016

(54) GREASE FOR ELECTRICAL CONTACT AND SLIDE ELECTRICITY STRUCTURE, POWER SWITCH, VACUUM CIRCUIT BREAKER, VACUUM INSULATED SWITCHGEAR, AND VACUUM-INSULATED SWITCHGEAR ASSEMBLING METHOD

(75) Inventors: Takashi Sato, Mito (JP); Kazuhiro Sato, Hitachinaka (JP); Ayumu Morita, Hitachi (JP); Kenji Tsuchiya, Hitachi (JP); Takao Kanno, Kitaibaraki (JP); Toshio Nitta, Kitaibaraki (JP)

(73) Assignees: Hitachi, Ltd., Tokyo (JP); NOK Klueber Co., Ltd., Tokyo (JP)

( * ) Notice: Subject to any disclaimer, the term of this patent is extended or adjusted under 35 U.S.C. 154(b) by 522 days.

(21) Appl. No.: 13/456,710

(22) Filed: Apr. 26, 2012

(65) Prior Publication Data

US 2012/0276755 A1 Nov. 1, 2012

(30) Foreign Application Priority Data

Apr. 27, 2011 (JP) ..... 2011-098999
Apr. 17, 2012 (JP) ..... 2012-093846

(51) Int. Cl.
*H01H 33/666* (2006.01)
*H01H 3/62* (2006.01)
(Continued)

(52) U.S. Cl.
CPC ..... *C10M 169/02* (2013.01); *H01H 3/62* (2013.01); *H01H 33/666* (2013.01); *C10M 2213/0606* (2013.01); *C10M 2213/0626* (2013.01); *C10N 2220/021* (2013.01); *C10N 2220/082* (2013.01); *C10N 2240/20* (2013.01);
(Continued)

(58) Field of Classification Search
CPC ..... C10M 2213/062; C10M 169/02; H01H 1/02; H01H 3/62; H01H 33/666; H02B 13/02
USPC ..... 218/118–126, 130, 140, 153, 154, 10; 508/182
See application file for complete search history.

(56) References Cited

U.S. PATENT DOCUMENTS 6,025,307 A * 2/2000 Chittofrati et al. ..... 508/182
6,396,018 B1 5/2002 Kinoshita et al.
(Continued)

FOREIGN PATENT DOCUMENTS

CN 1291815 A 4/2001
CN 1728307 A 2/2006
(Continued)

OTHER PUBLICATIONS

Chinese Office Action dated Apr. 2, 2014 (12 pages).
(Continued)

*Primary Examiner* — Amy Cohen Johnson
*Assistant Examiner* — Marina Fishman
(74) *Attorney, Agent, or Firm* — Crowell & Moring LLP

(57) ABSTRACT

A slide electricity structure according to the present invention uses grease for electrical contacts wherein contact resistance does not gradually increase even when exposed to sliding and lifetime is long, and has a silver-plated spring contact that contacts or separates by way of sliding and grease for electrical contacts that has been applied to the spring contact and contains perfluoropolyether oil having an average molecular weight between 2600 and 12500 as a base oil and PTFE having a primary particle diameter of 1 μm or less as a thickener.

8 Claims, 5 Drawing Sheets

(51) Int. Cl.

| | |
|---|---|
| ***C10M 169/02*** | (2006.01) |
| *H01H 1/60* | (2006.01) |
| *H01H 33/66* | (2006.01) |

(52) U.S. Cl.

CPC ..... *C10N 2240/202* (2013.01); *C10N 2250/10* (2013.01); *H01H 1/60* (2013.01); *H01H 33/6606* (2013.01); *Y10T 29/49204* (2015.01)

(56) References Cited

U.S. PATENT DOCUMENTS

| | | | | |
|---|---|---|---|---|
| 2005/0048675 | A1 | 3/2005 | Ikeda | |
| 2007/0075046 | A1 | 4/2007 | Nakamura et al. | |
| 2008/0032904 | A1 | 2/2008 | Watanabe et al. | |
| 2009/0200270 | A1* | 8/2009 | Chen et al. ..... | 218/119 |
| 2011/0036811 | A1 | 2/2011 | Utsumi et al. | |

FOREIGN PATENT DOCUMENTS

| | | | |
|---|---|---|---|
| CN | 101589077 | A | 11/2009 |
| CN | 101996815 | A | 3/2011 |
| EP | 1 416 503 | A2 | 5/2004 |
| EP | 1 520 906 | A1 | 4/2005 |
| JP | 3-244694 | A | 10/1991 |
| JP | 9-306326 | A | 11/1997 |
| JP | 9-326227 | A | 12/1997 |
| JP | 11-97293 | A | 4/1999 |
| JP | 11-260606 | A | 9/1999 |
| JP | 2002-343168 | A | 11/2002 |
| JP | 2004-152625 | A | 5/2004 |
| JP | 2005-68391 | A | 3/2005 |
| JP | 2005-79258 | A | 3/2005 |
| JP | 2005-268037 | A | 9/2005 |
| JP | 3920253 | B2 | 2/2007 |
| JP | 2007-80764 | A | 3/2007 |
| JP | 2008-138138 | A | 6/2008 |
| JP | 2008-204635 | A | 9/2008 |
| JP | 2011-41407 | A | 2/2011 |
| TW | M295328 | U | 8/2006 |
| TW | 200923071 | A | 6/2009 |
| WO | WO 2004/049366 | A1 | 6/2004 |
| WO | WO 2008/065163 | A1 | 6/2008 |
| WO | WO 2009/001778 | A1 | 12/2008 |

OTHER PUBLICATIONS

Taiwanese Office Action dated Apr. 18, 2014 (four pages).
Japanese Office Action with English translation dated Oct. 2, 2012 (six (6) pages).
Partial European Search Report dated Oct. 1, 2012 (seven (7) pages).
European Search Report dated Feb. 7, 2013 (twelve (12) pages).

* cited by examiner

GREASE FOR ELECTRICAL CONTACT AND SLIDE ELECTRICITY STRUCTURE, POWER SWITCH, VACUUM CIRCUIT BREAKER, VACUUM INSULATED SWITCHGEAR, AND VACUUM-INSULATED SWITCHGEAR ASSEMBLING METHOD

CLAIM OF PRIORITY

The present application claims priority from Japanese Patent applications serial No. 2011-98999, filed on Apr. 27, 2011 and No. 2012-93846, filed on Apr. 17, 2012, the respective contents of which are hereby incorporated by reference into this application.

TECHNICAL FIELD

The present invention relates to grease for electrical contacts and a slide electricity structure, a power switch, a vacuum circuit breaker, a vacuum-insulated switchgear, and a vacuum-insulated switchgear assembling method.

BACKGROUND ART

Patent Literature 1 discloses one of conventional art relating to grease for electrical contacts and a slide electricity structure to which the grease is applied to. Patent Literature 1 describes that the lubricant contains one or more kinds of additive among mercaptobenzothiazole compounds and dibenzothiazyl disulfides in addition to a mixture of polyalpha olefin or liquid paraffin as a main component and polybutene as a thickener in order to provide grease for electrical contacts that can maintain long-term stable lubrication as well as providing a contact which applies the grease.

Patent Literature 2 describes that grease for electrical contacts that is composed of a base oil excluding fluorine-based oil in the amount of 95% to 70% by weight and a thickener and an additive in the amount of 5% to 30% by weight has been applied onto an electrical contact thereby preventing damage to the contact area in the event an arc may occur when the electrical contact is open. Patent Literature 2 also describes that the thickener is preferably organificated bentonite; the base oil is preferably ester oil, glycol oil, or polyalpha olefin; and the base oil is preferably of low viscosity because arc energy would be low.

CITATION LIST

Patent Literature

[PTL 1] Japanese Patent No. 3920253

[PTL 2] Japanese Patent Laid-Open No. 2007-80764 (Corresponds to US2007/0075046A1)

SUMMARY OF INVENTION

Technical Problem

Because conventional grease for electrical contacts contains an azo additive, when it is applied to a silver-plated contact to stabilize contact resistance, it reacts with the plated silver thereby forming a passivation film having low conductivity. As a result, contact resistance sometimes gradually increases due to sliding motion.

Furthermore, because the use of a low-viscosity base oil reduces a product's lifetime of grease, when it is applied to a power switch having a product's lifetime of several tens of years, periodic greasing every several years is considered necessary.

In the light of the above, an object of the present invention is to provide grease for electrical contacts whose contact resistance does not gradually increase even when exposed to sliding, while having a long lifetime, and a slide electricity structure, a power switch, a vacuum circuit breaker, a vacuum-insulated switchgear, and a vacuum-insulated switchgear assembling method using the grease for electrical contacts.

Solution to Problem

To achieve the above object, as a first invention, grease for electrical contacts according to the present invention is characterized in that (1) the grease's base oil is perfluoropolyether oil having an average molecular weight between 2600 and 12500, (2) the grease's thickener is PTFE (polytetrafluoroethylene) having a primary particle diameter of 1 μm or less, and (3) a compound, such as an azo compound, which reacts with silver when exposed to sliding, is not included.

Furthermore, to solve the above problem, a slide electricity structure according to the present invention comprises a silver-plated spring contact which contacts or separates by way of sliding, and grease for electrical contacts which has been applied to the spring contact and contains perfluoropolyether oil having an average molecular weight between 2600 and 12500 as a base oil and PTFE having a primary particle diameter of 1 μm or less as a thickener.

Advantageous Effects of Invention

According to the present invention, it is possible to provide grease for electrical contacts whose contact resistance does not gradually increase even when exposed to sliding while having a long lifetime, or a slide electricity structure of which contact resistance does not gradually increase while having a long lifetime.

DESCRIPTION OF EMBODIMENTS

Hereafter, embodiments of the present invention will be described with reference to the drawings.

Example 1

Figure 1:
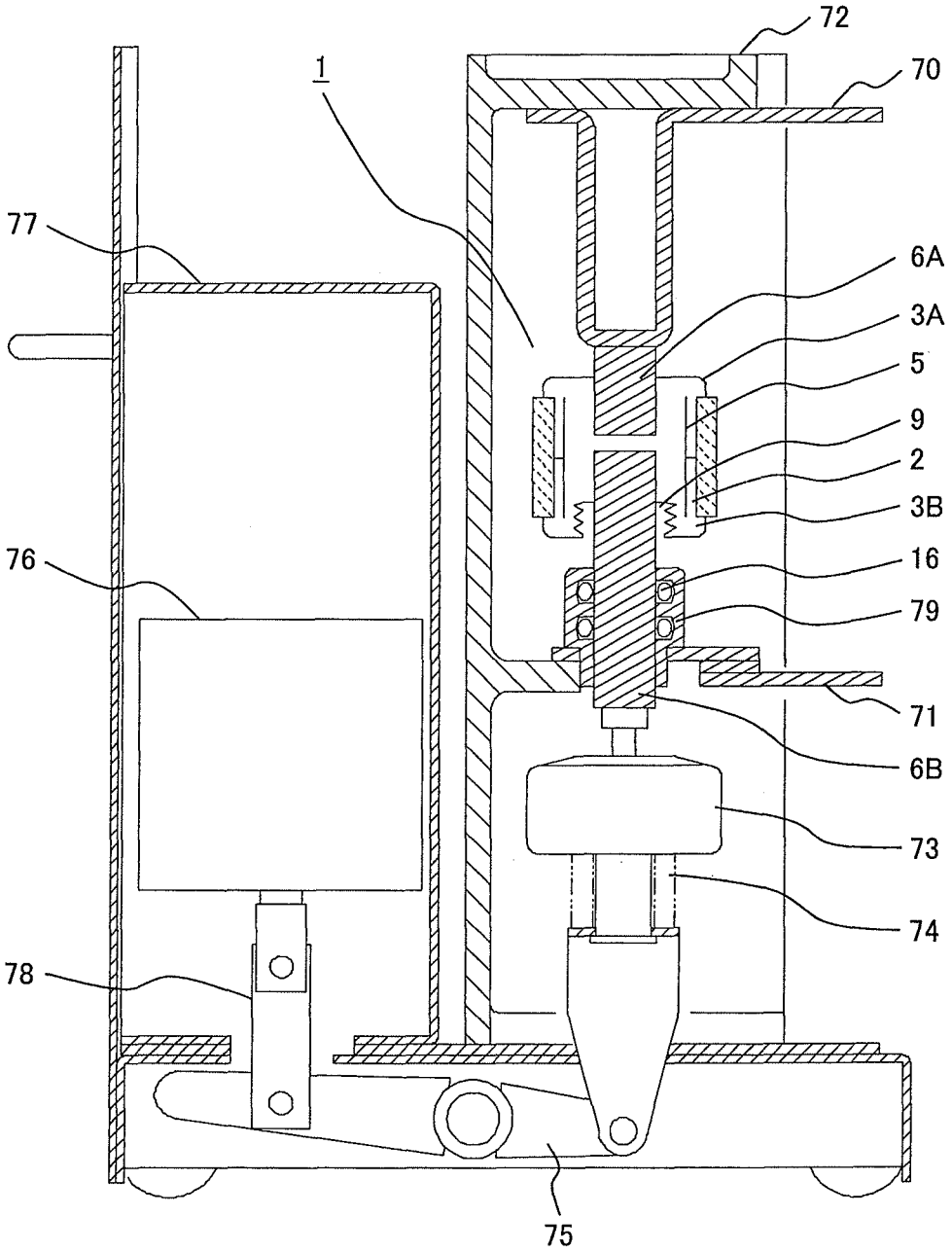
FIG. 1 is a sectional side view illustrating a vacuum circuit breaker that is an example of a slide electricity structure to which grease for electrical contacts according to the present invention has been applied.

FIG. 1 illustrates an example of a vacuum circuit breaker which is embodiment 1 of a slide electricity structure to which grease for electrical contacts according to the present invention has been applied.

As illustrated in the drawing, the vacuum circuit breaker schematically comprises a vacuum valve 1 having at least a pair of contacts that can be freely opened and closed, a fixed terminal 70 and a movable terminal 71 connected to the vacuum valve 1, an insulated tube 72 surrounding therearound, an insulated operating rod 73 connected to the movable electrode 6B of the vacuum valve 1, a wiping mechanism 74 for providing a contact force for the movable electrode 6B and the fixed electrode 6A of the vacuum valve 1, an operating device 76 for generating an operating force, an operating rod 78 connected to the operating device 76, a main lever 75 connecting the operating rod 78 to the wiping mechanism 74, and a housing 77 for encasing those devices.

The vacuum valve 1 encases the aforementioned fixed electrode 6A and movable electrode 6B in a vacuum chamber composed of a fixed end plate 3A, a ceramics-insulated tube 2, and a movable end plate 3B. The movable electrode 6B and the movable end plate 3B are connected by a bellows 9, which enables the movable electrode 6B to axially drive, thereby switching closing and interrupting states, while maintaining airtightness of the vacuum chamber.

Furthermore, an arc shield 5 is provided in the vacuum chamber to prevent the inner surface of the ceramics-insulated tube 2 from being contaminated by metal vapor occurring at the time of current interruption. The movable side of the vacuum valve 1 is provided with a spring contact 16 and a spring contact base 79 for holding the spring contact, thereby enabling the slide electricity between the movable electrode 6B and the movable terminal 71.

The grease for electrical contacts according to the present invention has been applied onto the electrical contact surface between the spring contact 16 and the movable electrode 6B. Furthermore, the surface of the spring contact 16 and the movable electrode 6B has been silver-plated to stabilize contact resistance.

Requirements for the grease for electrical contacts according to the present invention that has been applied to the thus-configured vacuum circuit breaker will be explained with reference to Table 1, FIG. 2, and FIG. 3.

Table 1 describes various combinations of grease for electrical contacts and a spring contact which have been studied for a vacuum circuit breaker and is applied to embodiment 1.

Figure 2:
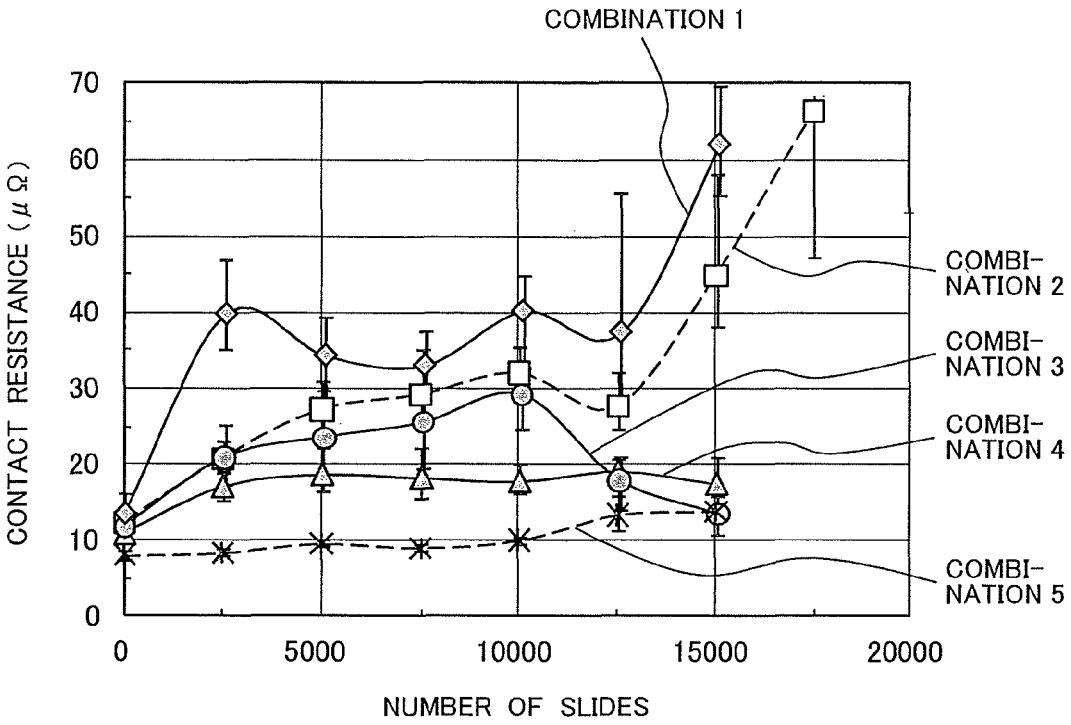
FIG. 2 is a characteristic diagram explaining the result of the actual measurement on the relationship between the contact resistance and the number of slides with regard to combinations 1 to 5, described in Table 1, of the slide electricity structure of the vacuum circuit breaker, to which grease for electrical contacts according to the present invention has been applied, illustrated in FIG. 1.

FIG. 2 explains the result of the actual measurement on the relationship between the contact resistance and the number of slides with regard to the slide electricity structure of combinations 1 to 5 described in Table 1. In combination 1 and combination 2, contact resistance increased as the number of slides increased, while in combination 3 and combination 4, contact resistance did not increase much. The grease for electrical contacts in combination 1 used synthetic hydrocarbon oil as a base oil. The grease for electrical contacts in combinations 2, 3, and 4 used perfluoropolyether as a base oil, and the grease for electrical contacts in combination 2 contained a characteristic adjustment additive. The grease for electrical contacts in combination 3 was the same grease as that was used in combination 2 with the exception that the characteristic adjustment additive was excluded from the grease. The grease for electrical contacts in combination 4 did not contain the characteristic adjustment additive from the beginning.

The result of the experiment has revealed that the grease for electrical contacts used in combination 3 and combination 4 where contact resistance did not increase much have characteristics in that (1) the base oil is perfluoropolyether oil having an average molecular weight between 2600 and 12500, (2) the thickener of the grease is PTFE having a primary particle diameter of 1 μm or less, (3) consistency of the grease is from No. 0 to No. 2 NLGI consistency, (4) the grease does not contain a compound, such as an azo compound, which reacts with silver when exposed to sliding, and (5) the grease does not contain a solid material having a particle diameter of 3 μm or more.

As stated above, it is considered that the grease exerts desired characteristics due to the following mechanism.

First, for grease to flow onto sliding surfaces and have a lubricating effect, it is necessary for the grease to maintain its fluidity and move onto a sliding portion following the sliding motion. To do so, it is necessary to prevent hardening due to the evaporation of oil and prevent spill due to gravity or vibration.

The average molecular weight of the base oil that satisfies those conditions is between 2600 and 12500; and if it is less, the grease tends to harden due to the evaporation of the base oil; and if it is more, viscosity is too high and it is difficult for the grease to move onto the sliding portion. Furthermore, when the grease is softer than No. 0 NLGI consistency, the grease flows out from the sliding portion due to gravity or vibration; and when it is harder than No. 2 NLGI consistency, it is difficult to lubricate the sliding surfaces as the electrode portion slides.

Next, there are soap-based, complex soap-based, organic, and inorganic thickeners; however, the soap-based thickener is inferior in regard to heat resisting properties and is not suitable for the use under high-temperature environment. The complex soap-based thickener has better heat resisting properties; however, it tends to harden over time or when exposed to heat and has no long-term stability. The organic thickener is superior in regard to heat resisting properties and stability, and specifically, PTFE is most stable in regard to heat, water, and oxidation. If the particle diameter of PTFE is 1 μm or less, when it is applied to a slide electricity portion between silver-plated electrodes for a general vacuum switch, the electrical contact is not damaged and a lubrication effect is created. If the particle diameter is larger than 1 μm, adhesion or cohesion of PTFE is induced between the electrode surfaces when sliding occurs, which is considered to increase the thickness of the lubricating film and pose a problem for electrical contact.

Next, an azo compound sometimes reacts with silver when sliding occurs, creating a low-conductivity passivation film. Accordingly, when the azo compound is applied to a silver-plated electrode, a passivation film is formed due to sliding, causing contact resistance to gradually increase. Such additives are considered to be azo, sulfur, and phosphorus additives.

Moreover, it is considered that there is very little possibility that perfluoropolyether oil that is used as a base oil for fluorinated grease constituting this embodiment and PTFE that is used as a thickener will react with silver.

Lastly, if a solid component having a particle diameter of 3 μm or more is included in grease, it gets onto the contact surfaces between electrodes and creates a thicker lubricating film than necessary. Consequently, it is considered that electrical contact is disturbed resulting in a significant increase in contact resistance. Additives having a particle diameter of 3 μm or more include carbon particles, magnesium compounds, and titanium compounds. When a solid component's particle diameter was less than 3 μm, contact resistance did not increase.

Furthermore, contact resistance did not increase much in combination 5. However, as the result of the high-temperature acceleration weight loss test that had been separately conducted to simulate weight loss after several tens of years have passed, it was determined difficult to maintain the lubrication function for many decades without greasing because the use of turbine oil as a base oil causes enormous weight loss.

On the other hand, since the grease for electrical contacts used in the above combinations 3 and 4 use perfluoropolyether as a base oil, significant weight loss does not occur and the lifetime was determined to be several tens of years or longer.

TABLE 1

| Combination | Base oil | Thickener | Additive | Contact pressure | Contact resistance |
|---|---|---|---|---|---|
| Combination 1 | Synthetic hydrocarbon oil | Barium complex soap | Included | Low | High |
| Combination 2 | Perfluoropolyether | PTFE | Included | Low | High |
| Combination 3 | | PTFE | Not included | Low | Medium |
| Combination 4 | | PTFE | Not included | Low | Medium |
| Combination 5 | Turbine oil | — | Included | Low | Low |
| Combination 3A | Perfluoropolyether | PTFE | Not included | High | Low |
| Combination 4A | | PTFE | Not included | High | Low |

Figure 3:
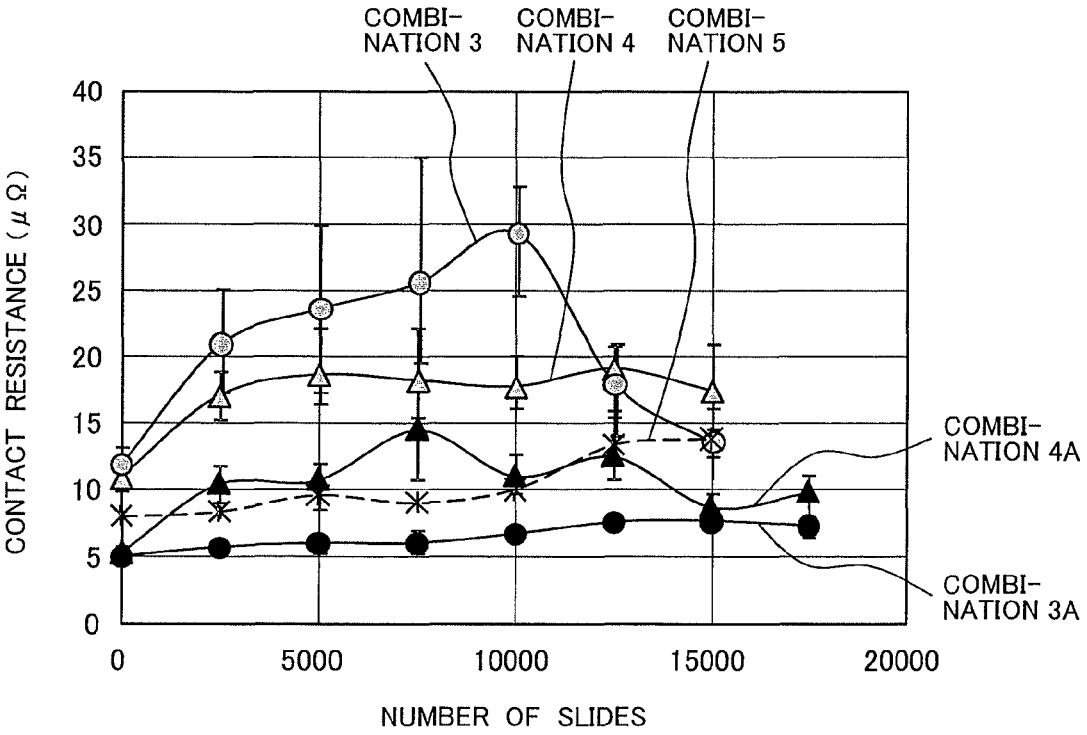
FIG. 3 is a characteristic diagram explaining the result of the actual measurement concerning the effect of a contact force of the spring contact on the relationship between the contact resistance and the number of slides with regard to combinations 3 and 4, described in Table 1, of the slide electricity structure of the vacuum circuit breaker, to which grease for electrical contacts according to the present invention has been applied, illustrated in FIG. 1.

FIG. 3 explains the result of the actual measurement on the effect of a contact force on the spring contact with regard to combinations 3 and 4 described in Table 1. In the drawing, with regard to combinations 3 and 4, those characteristics in FIG. 2 are repeatedly illustrated for comparison, and the contact force of the spring contact is 290 g/Coil. On the other hand, in the drawing, combinations 3A and 4A are the case where the contact force of the spring contact is 406 g/Coil, and it was possible to significantly suppress the increase in contact resistance.

When the contact force of the spring contact is less than 300 g/Coil, the amount of grease for electrical contacts that gets onto two surfaces composed of electrodes at the time of sliding increases; therefore, the thickness of the lubricating film between the electrodes gradually increases due to sliding, which increases contact resistance. However, when the contact force of the spring contact is 300 g/Coil or more, the amount of grease for electrical contacts that gets onto two surfaces composed of electrodes at the time of sliding decreases; therefore, a thin lubricating film is formed. Since grease for electrical contacts is difficult to be squeezed out as the lubricating film becomes thinner, change of film thickness becomes small. Consequently, change of contact resistance is considered to be suppressed.

Example 2

Figure 4:
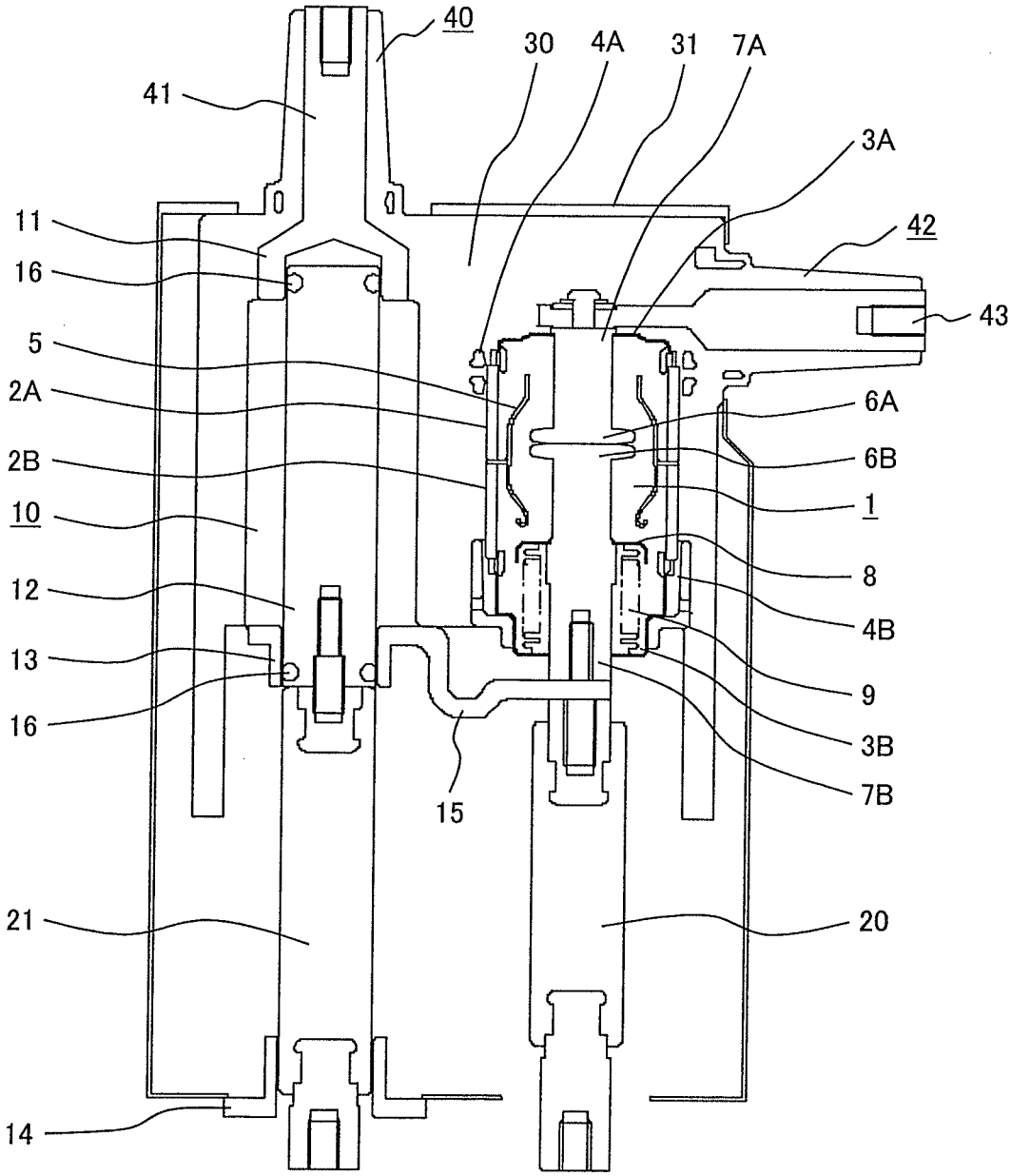
FIG. 4 is a sectional side view of a vacuum-insulated switchgear which is another example of the slide electricity structure to which grease for electrical contacts according to the present invention has been applied.

FIG. 4 illustrates an example of a vacuum-insulated switchgear which is a second embodiment of a slide electricity structure to which grease for electrical contacts according to the present invention has been applied.

As illustrated in the drawing, a vacuum-insulated switchgear is constructed such that a bus-bar bushing central conductor 41, a vacuum valve 1, a cable bushing central conductor 43, and an earthing disconnecting portion's bushing side fixed electrode 11 are cast-molded by a solid insulator 30, and the cast-molded structure is combined with a movable electrode 12 of an earthing disconnecting portion that linearly moves in the air, thereby constituting the earthing disconnecting portion 10 for switching the closing state, earthing state, and disconnecting state. In this embodiment, switching of three positions for closing, earthing, and disconnecting is enabled for reference; however, as far as the switch has a slide electricity structure, switching of two positions or four or more positions is possible. It goes without saying that positions, such as closing and interrupting, that are not provided for this embodiment can be provided.

A spring contact 16 is provided in the vicinity of both ends of the earthing disconnecting portion's movable electrode 12. By the earthing disconnecting portion's movable electrode 12 moving toward the earthing disconnecting portion's bushing side fixed electrode 11, electrical continuity from the earthing disconnecting portion's bushing side fixed electrode 11 to the earthing disconnecting portion's movable electrode 12 to the earthing disconnecting portion's intermediate fixed electrode 13 to the flexible conductor 15 is ensured, creating the closing state; and by the earthing disconnecting portion's movable electrode 12 moving toward the earthing disconnecting portion's earthing side fixed electrode 14, electrical continuity from the earthing disconnecting portion's earthing side fixed electrode 14 to the earthing disconnecting portion's movable electrode 12 to the earthing disconnecting portion's intermediate fixed electrode 13 to the flexible conductor 15 is ensured, creating the earthing state.

Those electrical contact surfaces have been silver-plated to stabilize contact resistance and coated with grease for electrical contacts according to the present invention.

Figure 5:
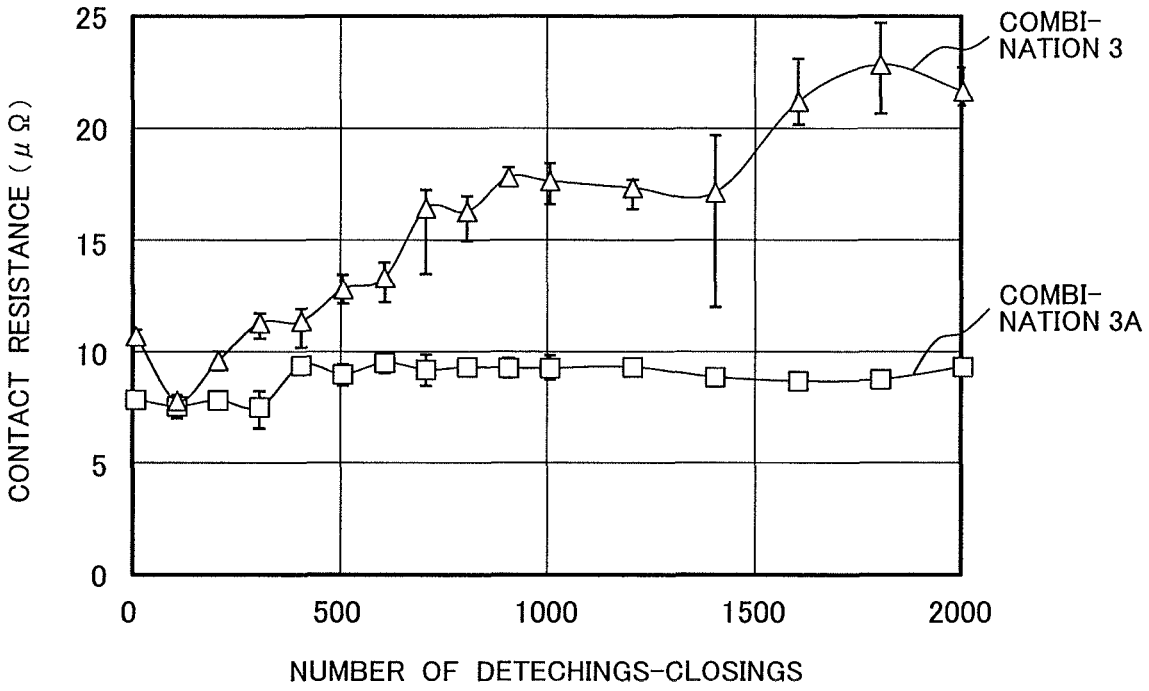
FIG. 5 is a characteristic diagram explaining the experiment result of the actual measurement with regard to two combinations of the grease for electrical contacts and the spring contact on the relationship between the contact resistance and the number of detachings-closings of the vacuum-insulated switchgear, to which grease for electrical contacts according to the present invention has been applied, illustrated in FIG. 4.

FIG. 5 explains the result of the actual measurement on the relationship between the contact resistance and the number of detachings-closings with regard to combinations 3 and 3A, described in Table 1, of the vacuum-insulated switchgear's slide electricity structure, to which grease for electrical contacts according to the present invention has been applied, illustrated in FIG. 4.

Combination 3 illustrated in the drawing is a sample electrode structure which combines grease for electrical contacts according to the present invention with a spring contact having contact pressure of less than 300 g/Coil. Combination 3A is a sample electrode structure which combines grease for electrical contacts according to the present invention with a spring contact having contact pressure of 300 g/Coil or more. FIG. 5 explains the characteristics of each combination.

As the drawing obviously illustrates, contact resistance gradually increases in combination 3, while contact resistance in combination 3A keeps almost constant.

Accordingly, characteristics of stable contact resistance can also be obtained in a structure, such as a vacuum-insulated switchgear illustrated in FIG. 4, where electrodes are completely separated from each other in the same manner as the structure, such as a vacuum circuit breaker illustrated in FIG. 1, where electrodes are always engaged with each other.

Figure 6:
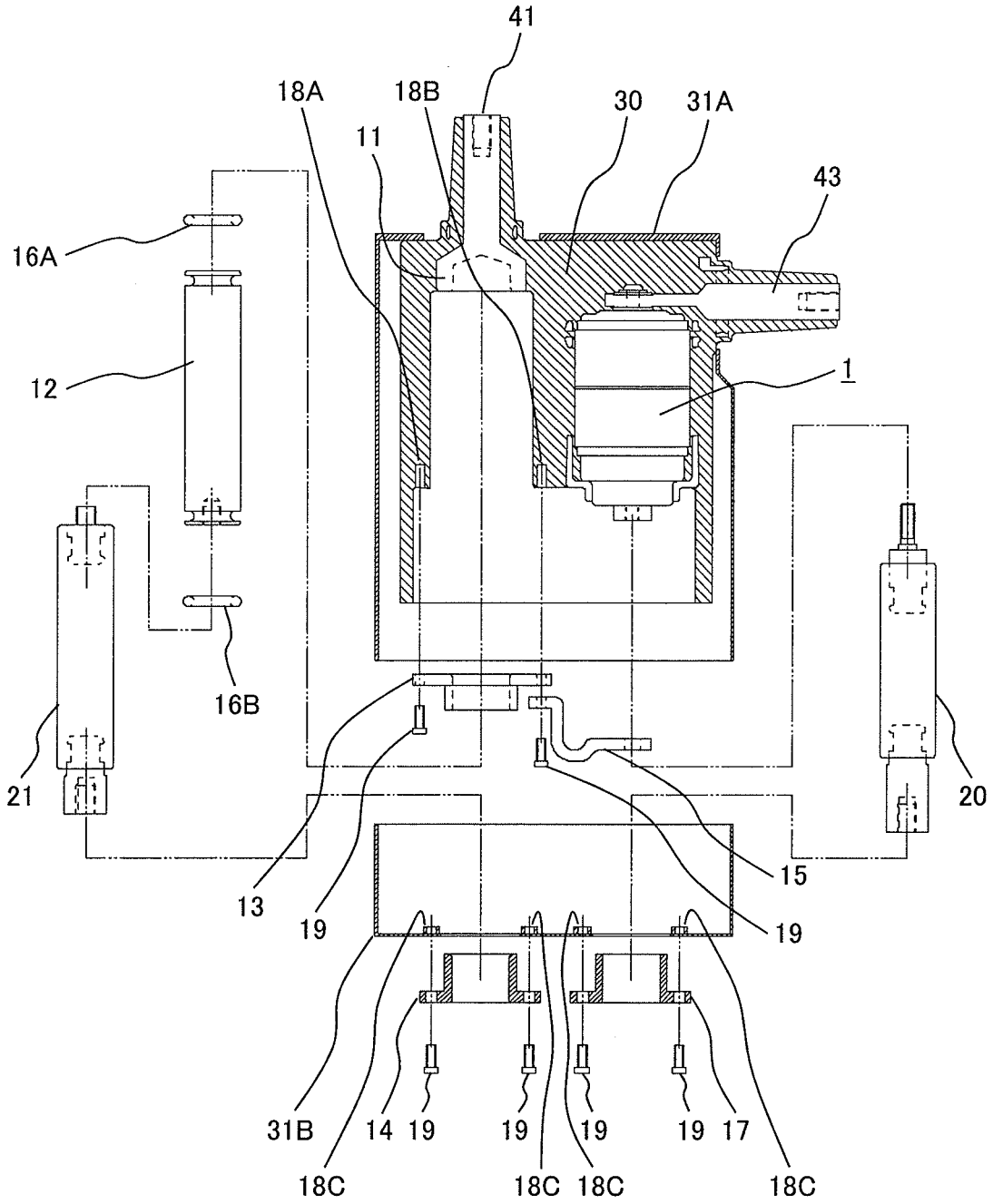
FIG. 6 is a sectional side view explaining a method of assembling the vacuum-insulated switchgear, to which grease for electrical contacts according to the present invention has been applied, illustrated in FIG. 4.

FIG. 6 explains a method of assembling a vacuum-insulated switchgear illustrated in FIG. 4. As described in the drawing, the vacuum-insulated switchgear is constructed such that a bus-bar bushing central conductor 41, a vacuum valve 1, a cable bushing central conductor 43 and an earthing disconnecting portion's bushing side fixed electrode 11 are first cast-molded by a solid insulator 30. Those are encased in a metal chamber 31A as needed, or coated with a conductive paint on the outer surface so as to stabilize electrical potential.

Next, the earthing disconnecting portion's intermediate fixed electrode 13 is fixed by a bolt 19 to a metal fastener 18A provided in the solid insulator 30, and one end of the flexible conductor 15 is fixed by a bolt 19 to a metal fitting 18B together with the earthing disconnecting portion's intermediate fixed electrode 13. The other end of the flexible conductor 15 is fastened to the movable holder 7B of the vacuum valve 1 by a bolt 19 which has been integrated into a vacuum valve operating rod 20.

Next, spring contacts 16A and 16B are coated with the aforementioned grease for electrical contacts, and engaged into the earthing disconnecting portion's movable electrode 12. The earthing disconnecting portion's movable electrode 12 is connected to the earthing disconnecting portion operating rod 21, and then inserted and assembled into the solid insulator 30 so that electricity can flows between the bus-bar bushing central conductor 41 and the spring contact 16A. In other words, the bus-bar bushing central conductor 41 and the spring contact 16A can come in contact with each other.

In this embodiment, the aforementioned grease for electrical contacts whose consistency has been adjusted to the No. 2 level consistency is applied. Maintaining proper viscosity of the grease enables the grease to be properly applied to the electrical contact surfaces of the bus-bar bushing central conductor 41 and also makes it possible to maintain lubrication and electricity performance without greasing for as long as several tens of years.

Next, the metal chamber lid 31B is fastened to the metal chamber 31A by a bolt, not illustrated, in an arrangement where the earthing disconnecting portion operating rod 21 and the vacuum valve operating rod 20 penetrate from an opening provided in the metal chamber lid 31B.

Next, the aforementioned grease for electrical contacts is applied onto the guide 17 which functions to prevent the earthing disconnecting portion's earthing side fixed electrode 14 and the vacuum valve operating rod 20 from deviating from the drive shaft, and the earthing disconnecting portion's earthing side fixed electrode 14 and the guide 17 are fastened to the metal chamber lid 31B by a nut 18C and a bolt 19 so that the guide 17 can slide with regard to the vacuum valve operating rod 20; thus the assembling is completed. It goes without saying that the earthing disconnecting portion's earthing side fixed electrode 14 has been fixed to the metal chamber lid 31B so that it can come in contact with the spring contact 16B.

In this embodiment, the same grease is used for the spring contacts 16A and 16B that are slide electricity portions to which a power-line side high voltage is applied and the sliding portions of the vacuum valve operating rod 20 and the guide 17 that are mechanically sliding portions. However, since required grease characteristics are different for the slide electricity portion and the mechanically sliding portion, different kinds of greases are usually applied. Use of different grease requires a plurality of greases to be prepared, increasing the number of ingredients. Furthermore, applying different kinds of greases requires dividing the work processes, thereby creating an increased burden on production.

Required performance of the grease that is applied to the slide electricity portion where current flows between two surfaces that come in contact due to sliding is that contact resistance is low from the initial state and does not increase over time. This is because if contact resistance becomes high, electricity loss increases, the amount of generated heat increases accordingly, and it becomes necessary to increase cooling performance. Great electricity loss also results in great energy loss. To decrease contact resistance, it is effective for grease not to include a compound, such as azo, sulfur, and phosphorus compounds, which forms a passivation film by reacting with plated silver.

On the other hand, required performance of the grease that is applied to the mechanically sliding portion where the flow of current is not assumed and isolation characteristics is to be increased is the isolation resistance rather than the contact resistance. Thus, it is important that the grease does not contain a conductive component and permittivity is comparatively low.

The grease used in this embodiment can keep contact resistance low before and during the use and is suitable for the use on the slide electricity portion. Also, because the grease does not include a conductive component and permittivity is low, it is also suitable for the use on the mechanically sliding portion. Thus, it is not necessary to use different kinds of greases, and the same grease can be applied to the slide electricity portion's spring contact 16A and the mechanically sliding portion 16B. That is, it is possible to apply only single grease to both the slide electricity portion and the mechanically sliding portion, which does not increase the number of ingredients. Furthermore, the workflow does not have to be divided, which can reduce the burden on production.

Although the aforementioned procedures were described as an example, it is possible to form the earthing disconnecting portion's intermediate fixed electrode 13 and the flexible conductor 15 as one unit beforehand. Furthermore, it is also possible to first form the metal chamber lid 31B, earthing disconnecting portion's earthing side fixed electrode 14, and the guide 17 as one unit, and then fasten the unit to the metal chamber 31A by bolts, not illustrated, while allowing the earthing disconnecting portion operating rod 21 and the vacuum valve operating rod 20 to penetrate the unit. Furthermore, it is also possible to first create a structure wherein spring contacts 16A and 16B have been coated with the aforementioned grease for electrical contacts, engaged into the earthing disconnecting portion's movable electrode 12, and then the earthing disconnecting portion operating rod 21 has been fastened to the earthing disconnecting portion's movable electrode 12, and then insert the structure from the earthing disconnecting portion's earthing side fixed electrode 14 side at the end.

Since the grease for electrical contacts used in this embodiment does not include a compound, such as azo, sulfur, and phosphorus compounds, that reacts with plated silver, even if it attaches to the surface of the earthing disconnecting portion operating rod 21 or the vacuum valve operating rod 20, the electric field distribution is not affected, and isolation performance can be well maintained.

Furthermore, when the grease for electrical contacts used in this embodiment is applied to a mechanically sliding portion near an electrical contact, such as a guide 17, it is possible to maintain lubrication performance for as long as several tens of years without greasing. Thus, it is not necessary to selectively use different greases, and depending on the portion, it is possible to reduce the production process when compared with the situation where different kinds of greases need to be used.

The above described embodiments of the invention as well as the appended claims and figures contain multiple features in specific combinations. The skilled person will consider other combinations or sub-combinations of these features in order to adapt the invention as defined in the claims to his specific needs.

The invention claimed is:

1. Grease for electrical contacts, comprising:

perfluoropolyether oil having an average molecular weight between 2600 and 12500 as a base oil; and PTFE having a primary particle diameter of 1 μm or less as a thickener; wherein the grease does not substantially contain any azo, sulfur, and phosphorus additives, which reacts with silver when exposed to sliding, consistency of the grease is from No. 0 to No. 2 NLGI (National Lubricating Grease Institute) consistency, and the grease does not substantially include a solid component having a particular diameter of 3 μm or more.

2. A slide electricity structure, to which grease for electrical contacts is applied, comprising:

the grease for electrical contacts according to claim 1; and a spring contact having contact pressure of 300 g/Coil or more.

3. The slide electricity structure according to claim 2, wherein a movable electrode and a fixed electrode of the slide electricity structure are separated from each other in an interrupting state.

4. A power switch equipped with the slide electricity structure, to which grease for electrical contacts is applied, according to claim 2.

5. A power switch equipped with the slide electricity structure, to which grease for electrical contacts is applied, according to claim 3.

6. A vacuum circuit breaker, comprising:

a vacuum valve having at least a pair of a movable electrode and a fixed electrode which can open and close;

a fixed terminal and a movable terminal connected to the vacuum valve respectively;

an insulated tube which covers surroundings of the vacuum valve, the fixed terminal and the movable terminal;

a spring contact and a spring contact base supporting the spring contact provided on the movable side of the vacuum valve to make slide electricity between the movable electrode and the movable terminal possible; and the grease for electrical contacts according to claim 1 applied to electrical contact surfaces between the spring contact and the movable electrode.

7. A vacuum-insulated switchgear, comprising:

a bus-bar bushing central conductor;

a vacuum valve;

a cable bushing central conductor;

a solid insulator cast-molding the bus-bar bushing central conductor, the vacuum valve and the cable bushing central conductor, thereby constituting a cast-molded structure;

an earthing disconnecting portion having an earthing disconnecting portion's movable electrode linearly moving in the air, being combined with the cast-molded structure, and switching an earthing state and a disconnecting state, the earthing disconnecting portion being switched to a closing state by moving the earthing disconnecting portion's movable electrode to an earthing disconnecting portion's bushing side fixed electrode and switched to the earthing state by moving the earthing disconnecting portion's movable electrode to an earthing disconnecting portion's earthing side fixed electrode respectively;

a spring contact provided in the vicinity of both ends of the earthing disconnecting portion's movable electrode; and the grease for electrical contacts according to claim 1 applied to electrical contact surfaces of the spring contact and the earthing disconnecting portion's bushing side fixed electrode and electrical contact surfaces of the spring contact and the earthing disconnecting portion's earthing side fixed electrode, each of which come in contact with each other as the result of moving of the earthing disconnecting portion's movable electrode.

8. A method of assembling a vacuum-insulated switchgear, the vacuum-insulated switchgear, including a vacuum valve the inside of which is vacuum, having a closing or interrupting function, a vacuum valve operating rod for transmitting an operating force to a vacuum valve movable electrode in the vacuum valve, a guide which comes in contact with the vacuum valve operating rod by way of sliding, a switch having a fixed electrode, a movable electrode, a spring contact connected to the movable electrode and enabling electrical contact with the fixed electrode by way of sliding, and an operating rod connected to the movable electrode to transmit an operating force to the movable electrode, a bus-bar bushing central conductor connected to the fixed electrode in the switch or integrated into one unit, a cable bushing central conductor connected to a conductor drawn from the inside of the vacuum valve to the outside of the vacuum valve, and a solid insulator which encases the vacuum valve, the switch, the bus-bar bushing central conductor, and the cable bushing central conductor all together, the grease for electrical contacts according to claim 2 being applied to the spring contact, the method of assembling the vacuum-insulated switchgear comprising the steps of:

providing the vacuum valve;

encasing the vacuum valve, the fixed electrode of the switch, the bus-bar bushing central conductor and the cable bushing central conductor all together by the solid insulator;

applying the grease onto the spring contact;

thereafter connecting the spring contact to the movable electrode of the switch;

thereafter inserting the movable electrode into the solid insulator to build into a structure so that the bus-bar bushing central conductor and the spring contact are able to come in contact with each other;

applying the grease onto the guide; and thereafter mounting the guide slidably to the vacuum valve operating rod.

* * * * *